US010472699B2

(12) United States Patent
Baukloh et al.

(10) Patent No.: US 10,472,699 B2
(45) Date of Patent: Nov. 12, 2019

(54) METHOD AND APPARATUS FOR CONTINUOUS TREATMENT OF A METAL STRIP

(71) Applicant: BWG BERGWERK—UND WALZWERK—MASCHINENBAU GMBH, Duisburg (DE)

(72) Inventors: Dieter Baukloh, Duisburg (DE); Andreas Noe, Kerken (DE); Dirk Schaefer, Lagenfield (DE)

(73) Assignee: BWG BERGWERK—UND WALZWERK—MASCHINENBAU GMBH, Duisburg (DE)

( * ) Notice: Subject to any disclaimer, the term of this patent is extended or adjusted under 35 U.S.C. 154(b) by 8 days.

(21) Appl. No.: 15/513,512

(22) PCT Filed: Sep. 9, 2015

(86) PCT No.: PCT/EP2015/070615
§ 371 (c)(1),
(2) Date: Mar. 22, 2017

(87) PCT Pub. No.: WO2016/096173
PCT Pub. Date: Jun. 23, 2016

(65) Prior Publication Data

US 2017/0321298 A1 Nov. 9, 2017

(30) Foreign Application Priority Data

Dec. 18, 2014 (DE) ..... 10 2014 118 946

(51) Int. Cl.
*C21D 9/63* (2006.01)
*C21D 11/00* (2006.01)
(Continued)

(52) U.S. Cl.
CPC ..... *C21D 9/63* (2013.01); *C21D 11/00* (2013.01); *F27B 9/2476* (2013.01); *F27B 9/40* (2013.01)

(58) Field of Classification Search
CPC ... C21D 9/63; C21D 11/00; F27B 9/40; F27B 9/2476
(Continued)

(56) References Cited

U.S. PATENT DOCUMENTS 3,576,664 A * 4/1971 Swartz ..... B05D 3/0281 219/609
5,964,114 A * 10/1999 Noe ..... B21B 37/28 72/11.7
(Continued)

FOREIGN PATENT DOCUMENTS

JP H03120318 B 5/1991

*Primary Examiner* — Steven B McAllister
*Assistant Examiner* — John E Bargero
(74) *Attorney, Agent, or Firm* — Andrew Wilford

(57) ABSTRACT

The invention relates to a device for continuous treatment of a metal strip (1), in particular a metal strip consisting of aluminum or an aluminum alloy, or consisting of a non-ferrous metal or a non-ferrous metal alloy, said device comprising at least one temperature control device (2) through which the metal strip (1) is guided in a floating manner, and comprising at least one strip position regulation unit (7), by means of which the position of the metal strip (1) can be controlled or regulated on the belt movement plane (E) and transversely to the strip running direction (B), wherein the temperature control device (2) has at least one entry-side heating section (3) and an exit-side cooling section (4). The invention is characterised in that the strip position regulation unit (7) that works in a contactless manner has at least one contactless strip position detection element (12) and at least one linear motor (13) and is
(Continued)

Figure 1:
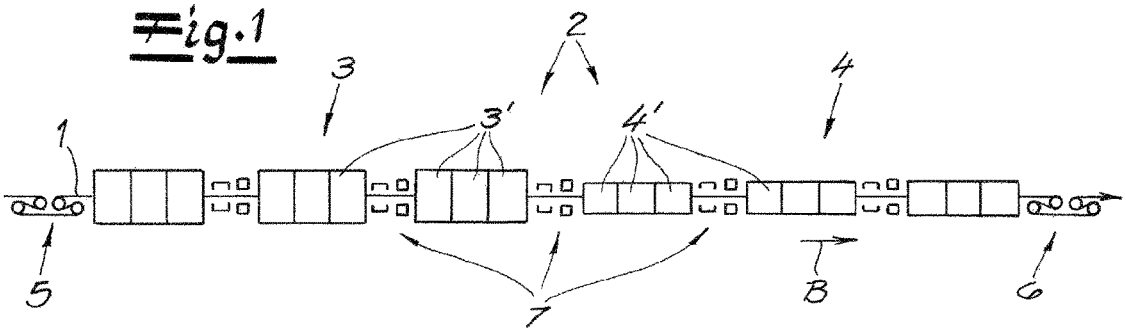

arranged within the heating section (3) or between the heating section (3) and the cooling section (4).

16 Claims, 1 Drawing Sheet

(51) Int. Cl.
*F27B 9/24* (2006.01)
*F27B 9/40* (2006.01)

(58) Field of Classification Search
USPC ..... 432/8
See application file for complete search history.

(56) References Cited

U.S. PATENT DOCUMENTS

| | | | | |
|---|---|---|---|---|
| 6,413,470 | B1 | 7/2002 | Kramer | |
| 6,448,764 | B2 | 9/2002 | Noe | |
| 6,874,724 | B2 * | 4/2005 | Muller | B21B 37/68 226/184 |
| 6,895,692 | B2 | 5/2005 | Kramer | |
| 8,728,244 | B2 | 5/2014 | Behrens | |
| 2008/0309171 | A1 * | 12/2008 | Sadarangani | H02K 41/031 310/15 |
| 2010/0161104 | A1 * | 6/2010 | Lofgren | B21B 37/007 700/109 |
| 2012/0067096 | A1 * | 3/2012 | Molander | G05D 19/02 72/17.3 |
| 2014/0110890 | A1 * | 4/2014 | Noe | C21D 9/54 266/44 |
| 2017/0327936 | A1 * | 11/2017 | Ishigaki | B65H 23/188 |

* cited by examiner

METHOD AND APPARATUS FOR CONTINUOUS TREATMENT OF A METAL STRIP

CROSS REFERENCE TO RELATED APPLICATIONS

This application is the US-national stage of PCT application PCT/EP2015/070615 filed 09 Sep. 2015 and claiming the priority of German patent application 102014118946.9 itself filed 18 Dec. 2014.

The invention relates to an apparatus for continuously treating a metal strip, in particular a metal strip made of aluminum or an aluminum alloy or nonferrous metal (for example copper) or a nonferrous metal alloy, using at least one temperature adjuster that guides the metal strip so that it is suspended, and comprising at least one strip-position adjuster for controlling the position of the metal strip with or without feedback in the plane of movement of the belt and transversely to the travel direction of the belt, the temperature adjuster having at least one heating zone at the intake end and one cooling zone at the output end.

The temperature adjuster is preferably a suspended belt furnace that has a heating zone and a cooling zone. The heating zone usually consists of multiple heating zones (heating subzones and/or holding subzones) and the cooling zone usually consists of several cooling subzones. The metal strip is heated to a certain (ideal) temperature in such a temperature adjuster, optionally kept at this temperature for a certain period of time and then cooled again. The passage through the furnace takes place without contact, in that the strip is suspended between nozzles, for example air nozzles acting upon the strip with the proper air pressure. The cooling that takes place in the cooling subzones may be done with air, water or a combination of air and water. Such suspended-strip furnaces with a heating subzone on one end and a cooling subzone on the other end are known (cf., for example DE 198 04 184 [U.S. Pat. No. 6,413,470]).

Such an apparatus of the type described above for continuously treating a metal strip with a temperature adjuster and/or a suspended-strip furnace may for example be an annealing line and/or a continuous annealing line in which the metal strip undergoes heat treatment for metallurgical reasons, for example to achieve certain strength and shaping properties. Alternatively, however, the apparatus may also be a strip-coating installation and/or a strip-coating line in which heat treatment of the metal strip does not take place in the sense of annealing but instead is for the purpose of drying a coating on the strip so that the furnace is then a continuous tunnel dryer.

The metal strip is preferably an aluminum or nonferrous metal strip (and/or the corresponding alloys) of a thickness of 0.1 mm to 6 mm.

Since the metal strip is heated to temperatures close to the melting point in for example annealing lines, it is usually necessary to adjust a relatively low strip tension within the temperature adjuster in order to prevent the strip from cracking. To do so, the strip tension is reduced at the upstream intake end in a tension rolling set, for example and is built up again in another tension rolling set at the output end after cooling. In the temperature adjuster (for example in the suspended-strip furnace), the specific strip tension is 0.5 to 1 MPa, for example. Since the strip can run off-center at the low strip tension in the furnace in particular due to any strip camber, it is for example necessary to position the strip in a suitable manner with the help of a strip-position adjuster, preferably to center the strip. The positioning accordingly takes place in the plane of travel of the strip, transversely to the strip-travel direction.

In practice, due to the rapidly growing demand for vehicle body strips made for example of aluminum there is a demand for more and more efficient continuous annealing lines. To achieve greater production capacities, the strip passes through the strip treatment section at a higher speed. However, since only a limited amount of heat input into the strip can be done per furnace subzone, it thus follows that the temperature adjuster would have to be designed to be longer for a higher production capacity. However, since the strip runs off-center more easily in the furnace section because of the low strip tension there, there is the risk in the case of long furnaces that the known strip-position adjusters would no longer be able to maintain stable strip travel in the furnace so that there is the risk of the strip running off-center laterally and/or coming up against the furnace structure. This can lead to unwanted strip damage or even to cracking of the strip so that installations with an increased production capacity cannot readily be constructed in this way. Against this background, it was already proposed in DE 10 2012 110 010 [US 2014/0110890] that the strip-position adjuster should be inside the cooling zone. Thus, the strip-position adjuster is no longer downstream of the temperature adjuster at the downstream output end and consequently is no longer set up downstream of the furthest downstream cooling subzone but instead is also integrated into the cooling zone by dividing the latter preferably into two cooling subzones. In a furthest upstream segment, the strip is cooled down to the extent that it can pass through the strip-position adjuster without any problem. The furthest upstream cooling subzone is downstream of the strip-position adjuster. Then the strip passes through the second cooling subzone, and consequently, through the second portion of the cooling subzones so that the strip is then cooled down to the desired final temperature. It is possible in this way to operate with a long furnace section on the whole, and consequently, with long heating zones and cooling zones so that the production capacity is increased. The strip-position adjuster with the known installation is a traditional triple-roller regulating unit, for example that can be integrated into the cooling zone at low temperatures accordingly with no problem. Alternatively, it was also proposed in DE 10 2012 110 010 that the strip-position adjuster, which is integrated into the cooling zone, should be a strip-position adjuster operating without contact using for example linear actuators.

Due to the measures described in DE 10 2012 110 010, the furnace section can be lengthened as compared to installations known previously. However, there is a need to further increase the throughput capacity. That is where the present invention begins.

The object of the invention is to provide an apparatus for continuously treating a metal strip of the type defined above in which satisfactory strip running is ensured, even in very long furnace sections.

To attain this object, the invention teaches that the strip-position adjuster operating without contact in a generic apparatus for continuously treating a metal strip has at least one noncontact strip-position detector and at least one linear actuator and is inside the heating zone or between the heating zone and the cooling zone.

The invention is based on the discovery that it is not necessary to provide the strip-position adjuster in the cooling zone, but instead when using a noncontact strip-position adjuster based on linear actuators, there is the option of putting it upstream of the cooling zone and consequently inside the heating zone or between the heating zone and the cooling zone. According to the invention, linear actuators are used in the strip-position adjuster, such as those described in DE 197 19 994 [U.S. Pat. No. 5,964,114] and those already mentioned in DE 10 2012 110 010. They are integrated into the heating zone according to the invention. The provision of the noncontact strip-position adjuster inside the heating zone and/or between the heating zone and the cooling zone means that at least the linear actuator and optionally also the noncontact strip-position detector of the strip-position adjuster is/are inside the heating zone or between the heating zone and the cooling zone. The linear actuators act transversely to the strip-travel direction so that strip movement transversely to the direction of strip travel (in the plane of the strip travel) can be corrected. Therefore, in contrast with the procedure described in DE 197 19 994, all the linear actuators are working in the same (transverse) direction so that no transverse stresses are built up in the strip. Consequently, the linear actuators do not serve to create strip stresses but instead serve only to correct the strip travel, i.e. the positioning of the strip transversely to the direction of strip travel (in the plane of the strip).

Whereas with traditional installations, the length of the heating zone was limited, because a strip-position adjuster was only provided downstream of or inside the cooling zone, now according to the present invention, there is the option of lengthening the heating zone to "any length." For example if one were to assume that because of the path of the strip, the empty space, i.e. the distance between one roller and the downstream strip-position adjuster or the distance between two strip-position adjusters immediately downstream of one another must not be more than 100 m to 130 m, depending on the quality of the strip, and the strip-position adjuster in the prior art was always downstream of the cooling zone or was optionally integrated into the cooling segment, thus the lengths of the heating zones have in the past been limited to lengths much less than 100 m. According to the invention, this restriction now no longer applies because the heating zone can readily be extended to lengths of more than 100 m due to one or more strip-position adjusters being located inside the heating zone because the strip travel according to the present invention can be corrected within the heating zone with the help of linear actuators. Thus, in a preferred refinement, the invention proposes that the (empty) space between two strip-position adjusters provided (directly) one downstream of the other along the working direction (for example between the linear actuators) should be less than 100 m, preferably less than 80 m, for example less than 60 m and especially preferably less than 40 m. Consequently, there is the possibility of providing strip-position adjusters at certain horizontal spacings inside the heating zone (and also optionally inside the cooling zone) so that there are no longer any restriction on the length of the heating zone along the strip-travel path.

Consequently, the strip-position adjuster consists of at least one linear actuator and at least one strip-position detector (for example a sensor), and these components are connected to a suitable electronic controller. A linear actuator consists basically of a stator and/or an inductor and an armature, and the special feature of the invention is that the armature is formed by the metal strip itself. The stator and/or the inductor consist of coils that generate an electromagnetic alternating field. The corresponding correction movement that is effective on the armature is based on a continuous repulsion between the stator field and the armature field. Within the scope of the invention, nonferro-magnetic metal strips are especially preferred for use here. In this case, it is advantageous if linear actuators (and/or their stators) are both above the strip and beneath the strip, the metal strip passing through the gap between the stators with an adjustable spacing (see DE 197 19 994). The linear actuators are designed and positioned so that they act transversely to the strip-travel direction. The travel path of the strip is corrected due to the fact that all the linear actuators act opposite the strip-travel direction (in other words, opposite the course of the strip). The force of the linear actuators on the strip is especially preferably controlled in proportion to the measured deviation of the strip, but conceivable strategies also include those in which, for example the linear actuators work only when the deviation of the strip has exceeded a predetermined limit or the force is increased disproportionately to the deviation of the strip. Due to the fact that all the linear actuators are acting in one direction, no transverse tension is built up in the strip in contrast with DE 197 19 994.

The temperature adjuster preferably consists of a plurality of temperature regulating subzones and/or furnace subzones in a basically known manner. Thus, for example the heating zone may have a plurality of heating subzones, and the cooling zone may have a plurality of cooling subzones. Such subzones may be characterized in that for example they can be thermally controlled independently of one another. According to the invention, it is optionally proposed that the noncontact strip-position adjuster, i.e. the linear actuator and/or the strip-position detector should be provided between two heating subzones (provided directly following one another). Consequently, it is not necessary to integrate the strip-position adjuster into the heating subzones in which the nozzles are, but instead sufficient installation space may be provided between two heating subzones to provide the linear actuator or linear actuators there as well as optionally also the strip-position detector. Thus, for example there is the possibility of combining several heating subzones into groups and providing a strip-position adjuster between two groups.

As already explained, the linear actuators operate transversely to the direction of strip travel and in the plane of the strip and/or in parallel to the plane of the strip, and the linear actuators and/or their stators are above and/or beneath the strip. It is advantageous if the linear actuators have transverse dimension at least equal to the transverse width of the strip (with maximum strip width). Consequently, the linear actuators and/or their stators extend over the total strip width (of the maximum strip to be processed in the line).

The open vertical spacing between the linear actuators (and/or their stators) provided above and below the strip is preferably at least 80 mm, especially preferably at least 100 mm.

It is especially important that the linear actuators are inside the heating zone and consequently inside the heating zone of the furnace. These are preferably locations of the furnace in which the temperature of the metal strip is more than 300° C., for example more than 400° C. For example if aluminum strips are treated in an annealing furnace, then the temperature of the aluminum strip is more than 500° C. Nevertheless, according to the invention it is possible to work with linear actuators in a noncontact operation. It is advantageous here to cool the linear actuators and/or their stators, preferably with water.

Furthermore, the fact that the strip position, i.e. the strip travel is detected in a noncontact process using noncontact strip-position detectors is also especially important. For example these may be inductive sensors, capacitive sensors or optical sensors. Alternatively, radar sensors may also be used. Such sensors may be provided inside the furnace, and consequently, in immediate proximity to the strip if they have sufficient thermal stability. However, there is also the possibility of providing radar sensors, for example at a spacing from the strip. Regardless of that, sensors and/or linear actuators and/or their stators can be not only cooled but also encapsulated suitably in order to keep thermal stress within limits. In contrast with traditional strip-position adjusters that operate with deflecting rollers, however, the strip-position adjusters according to the invention are not limited to use at relatively low temperatures.

As already explained, one or more strip-position adjusters (in other words, linear actuators and optionally sensors) may be provided especially advantageously within the heating zone according to the invention so that the spacing between two such strip adjusters may be relatively minor. Furthermore, it is optionally also proposed that the furthest upstream strip-position adjuster, for example its linear actuator, may be provided in the heating zone spaced downstream from the furthest downstream roller and/or strip-deflecting roller upstream of the heating zone such that this spacing is at least ten times, preferably at least twenty times the (maximum) strip width.

The subject matter of the invention is also a method of continuously treating a metal strip with an apparatus of the type described above, and the metal strip is guided in suspension through the heating zone and the cooling zone for thermal treatment. This method is characterized in that the position of the metal strip (in the plane of travel of the strip and/or parallel to the plane of travel of the strip and transversely to the strip-travel direction) is adjusted with or without feedback by at least one strip-position adjuster that operates without contact and is inside the heating zone or between the heating zone and the cooling zone. The deviation in the actual position (for example the actual central axis) of the strip from the ideal position (for example the ideal central axis) of the strip, for example to the central axis of the strip treatment installation is measured, and correction signals are generated from the deviation, and the strip is moved by the linear actuator or linear actuators into the ideal position, for example centered. In doing so, the linear actuators and/or the horizontal force component act(s) essentially at a right angle to the strip-travel direction (parallel to the plane of travel of the strip) and opposite the direction of strip deflection and/or of the coarse of the strip. The strip-position adjuster is preferably provided between two heating subzones. The strip-position adjuster, for example its linear actuator and/or its strip-position detector, is/are especially preferably provided in an area of the heating zone in which the temperature of the metal strip is more than 300° C., for example more than 400° C. Consequently, according to the invention, the strip position regulating method is not carried out inside the cooling zone but instead in the heating area.

In addition, the measurement of the actual position (based on the strip-travel direction) is performed upstream of the linear actuators and/or downstream of the linear actuators and/or at the position of the linear actuators. The measurement may consequently take place upstream of the linear actuators in the strip-travel direction. Alternatively, however, the measurement may also take place downstream of the linear actuators and there is also the possibility that linear actuators are upstream of the measurement and downstream of the measurement so that the linear actuators are between two measurement points, for example.

The force exerted on the strip by the linear actuators may be controlled transversely to the strip-travel direction in proportion to the measured strip course. It is also within the scope of the invention in the case of a deviation in the actual position from the ideal position within a tolerance range to refrain from a correction by the linear actuators.

Figure 2:
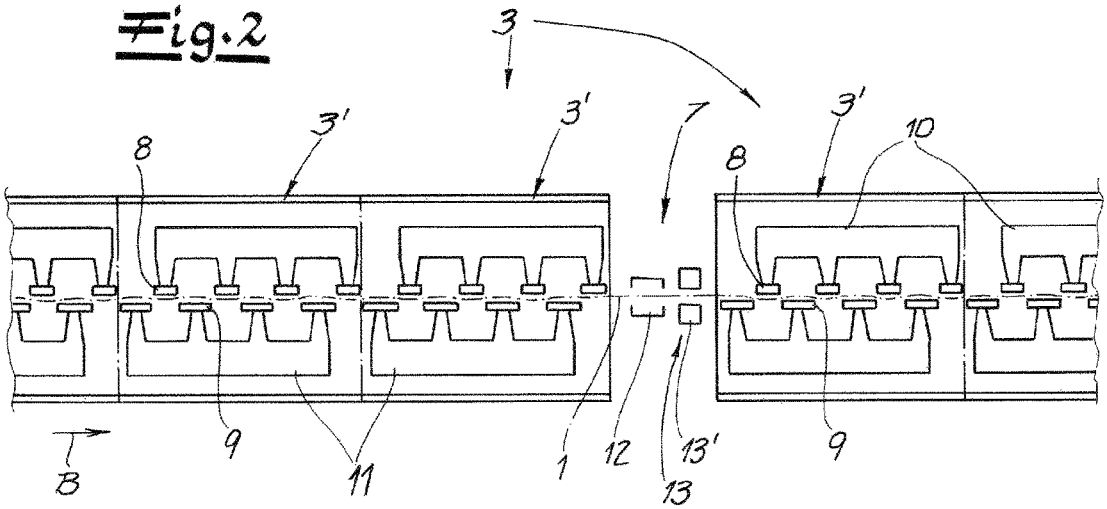
Figure 3:
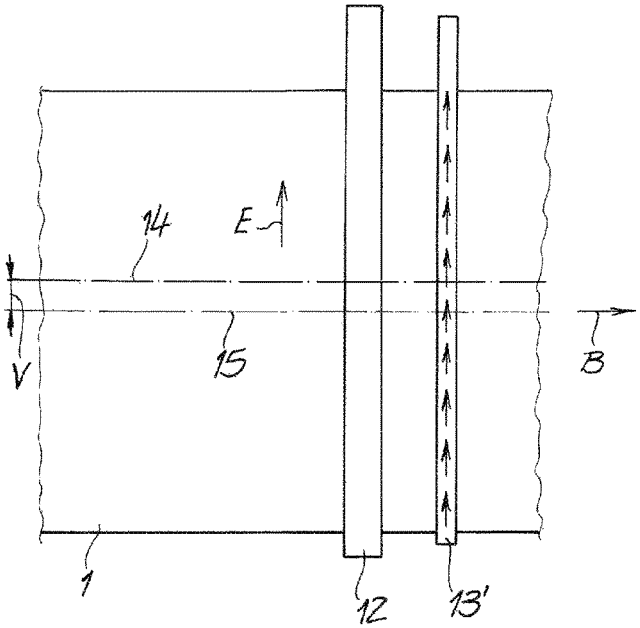

The invention is explained in greater detail below on the basis of a drawing that illustrates only one embodiment in which:

FIG. 1 is a simplified schematic diagram showing a strip-treatment apparatus, FIG. 2 an enlarged detail of the apparatus of FIG. 1, and FIG. 3 is a (simplified) top view of a metal strip inside the apparatus according to FIG. 2.

The figures illustrate in simplified views a strip-treatment apparatus for continuously treating a metal strip 1, namely a thermal treatment. This apparatus has a temperature adjuster 2 that is a suspended-strip furnace. The metal strip passes through this suspended-strip furnace 2 in a noncontact operation, in that nozzles 8 and 9 are acted upon by a corresponding pressure, for example superatmospheric pressure. The suspended-strip furnace 2 has a heating zone 3 at the upstream intake end and a cooling zone 4 at the downstream output end. The heating zone is comprised of a plurality of heating subzones 3', while the cooling zone is comprised of a plurality of cooling subzones 4', the individual subzones 3 and 4 being controllable individually or separately. The heating of the metal strip 1 is usually carried out with the help of air in the heating subzones 3' so that the nozzles 8 and 9 can also assume the function of temperature control in addition to their support function. The cooling usually also takes place with air or a combination of air and water in the cooling subzones 4'. In the case of an annealing line for aluminum strips for automotive body purposes, the ideal temperature (of the metal strips) in the heating subzone is about 550° C. to 570° C., for example. Consequently, the heating subzones 3' form heating subzones and holding subzones. FIG. 2 shows that the upper and lower nozzles 8 and 9 are offset transversely to the plane E of travel of the strip with a (vertical) nozzle spacing. A plurality of the furnace subzones, for example the heating subzones 3' and the cooling subzones 4' succeed one another in a strip-travel direction B, and the temperature of the subzones 3' and/or 4' can each be controlled thermally independently of one another. Within one furnace subzone 3', 4', the upper nozzles 8 are connected to an upper nozzle box 10 and the lower nozzles 9 are connected to a lower nozzle box 11. As a rule a separate fan is provided for each of these nozzle boxes 10 and 11, and the fans communicate with the nozzles 8 and 9 by distribution passages. Details of these designs are basically known.

FIG. 1 also shows that the installation has a tension roller set 5 at the intake end with which the strip tension is reduced, for example to a specific strip tension of 0.5 to 1 MPa. Downstream of the suspended-strip furnace 2 and/or downstream of the furthest downstream cooling subzone, a tension roller set 6 at the output end increases the strip tension to the usual line level of specifically 10 to 20 mPa, for example, customary for that line. Because of the low specific strip tension within the suspended-strip furnace, it is necessary to center the metal strip 1 with the help of a strip-position adjuster 7 and/or to keep it there.

Consequently, the apparatus according to the invention has one or more of the strip-position adjusters 7 that can control the position of the metal strip in the plane E of travel of the strip and/or transversely to the travel direction B of the strip with or without feedback.

According to the invention, at least one strip-position adjuster 7 is in the heating zone 3. This is illustrated in FIG.

2. The strip-position adjuster 7 operates without noncontact. It has at least one noncontact strip-position detector 12 and at least one linear actuator 13, and both the strip-position detector 12 and the linear actuator 13 are inside the heating zone 3 in this embodiment. The figures show that the strip-position adjuster 7 is between two heating subzones 3' of which one is positioned directly downstream of the other. The two heating subzones 3' are at a spacing from one another in the strip-travel direction, and the strip-position adjuster 7 is in the gap. In the embodiment according to FIG. 2, a linear actuator 13 is above the strip and beneath the strip, in that the stator 13' of the linear actuator 13 because the armature of the linear actuator 13 is formed by the metal strip itself.

It can be seen in FIG. 3 that, with the help of the linear actuator 13, a force is created acting parallel to a plane E of travel of the strip and transversely and/or orthogonally to the travel direction B of the strip. FIG. 3 shows the ideal central axis 14 of the strip 1 that for example corresponds to the central axis of the strip treatment machine. Furthermore, FIG. 3 indicates as an example the actual central axis 15, namely for the case when the actual central axis 15 is offset from the ideal central axis 14 by a deflection V of the strip. With the help of the strip-position detector 12, the position of the actual central axis 15 is measured relative to the ideal central axis 14 and correction signals are generated from the deviation. With the linear actuators 13, of which FIG. 3 shows only the upper linear actuator and/or its armature 13', the strip is moved into the desired position, i.e. into the ideal central position. To this end, the linear actuators 13, whose horizontal force component acts (essentially) perpendicular to the strip-travel direction and opposite the direction of deflection of the strip, act on the metal strip 1 that, as the armature, is also part of the linear actuator 13. FIG. 3 also shows that the linear actuators 13 extend over the total width of the strip and consequently cover the entire width of the strip. The sensor 12 shown here is a noncontact sensor and/or operates with noncontact functioning sensors, for example inductive sensors, capacitive sensors, optical sensors or also with a radar measurement.

The figures show only a strip-position adjuster 7. However, strip-position adjusters 7 are especially preferably also provided in the cooling zone 4 and between the heating zone 3 and the cooling zone 4, not just in the heating zone 3. With a suitable length of the heating subzone, a plurality of strip-position adjusters 7 may be integrated into the heating zone 3 so that a strip-position adjuster 7 may for example be provided at least once every 50 m, preferably at least once every 30 m, in the heating zone 3. It is possible in this way to work with furnaces of almost any desired length so that the capacity of the installation is increased.

Furthermore, it is self-evident that the strip-position adjuster integrated into the furnace (in other words, the linear actuator and the strip-position detector) is connected to a suitable electronic controller that of course need not be located inside the furnace and are not necessarily the subject matter of the strip-position adjuster according to the invention.

The invention claimed is:

1. In an apparatus for continuously treating a metal strip made of aluminum or an aluminum alloy or of nonferrous metal or a nonferrous metal alloy, the apparatus having at least one temperature adjuster through which the metal strip is passed in a suspended form in a strip-travel direction, and at least one strip-position adjuster that can control with or without feedback the position of the metal strip in a plane of travel of the strip and transversely to the strip-travel direction, the temperature adjuster having at least one heating zone at an intake end and one cooling zone at an output end, the improvement wherein the strip-position adjuster operates by a noncontact method and comprises:

at least one noncontact strip-position detector, at least one inductive linear actuator having a stator coil generating an alternating electromagnetic field that is effective transversely of the strip-travel direction and in the plane on the strip, and the strip-position adjuster is inside the heating zone or between the heating zone and the cooling zone.

2. The apparatus according to claim 1, wherein the heating zone has a plurality of heating subzones, and the noncontact strip-position adjuster and the strip-position detector are between two heating subzones.

3. The apparatus according to claim 1 having a plurality of the strip-position adjusters, wherein a space between a strip-deflecting roller upstream of the heating zone and the immediately downstream strip-position adjuster or between two strip-position adjusters positioned downstream of the other in the strip-travel direction between two linear actuators is less than 100 m.

4. The apparatus according to claim 1, wherein the linear actuator is above or below the strip.

5. The apparatus according to claim 1, wherein the linear actuator has a transverse dimension that is at least equal to a transverse width of a strip of maximum strip width.

6. The apparatus according to claim 1, wherein the linear actuator has a vertical open spacing of at least 80 mm.

7. The apparatus according to claim 1, wherein the linear actuator is water-cooled.

8. The apparatus according to claim 1, wherein the strip-position detector is an inductive, capacitive, optical, or radar sensor.

9. The apparatus according to claim 1, wherein the furthest upstream strip-position adjuster is spaced in the heating zone downstream from the furthest downstream strip-deflecting roller upstream of the heating zone at least ten times a width of the strip.

10. In a method of continuously treating a metal strip using an apparatus according to claim 1 and in which the metal strip is guided in suspension through the heating zone and the cooling zone for thermal treatment, the improvement comprising the step of:

adjusting a position of the metal strip with or without feedback by at least one strip-position adjuster that operates in a noncontact manner and is in the heating zone or between the heating zone and the cooling zone.

11. The method according to claim 10, wherein the position is adjusted by the steps of:

measuring a deviation in the actual position of a central axis of the metal strip from an ideal central position aligned with an ideal central axis of the metal strip, generating correction signals from the deviation, and moving the metal strip by the linear actuator or motors into the ideal position.

12. The method according to claim 10, wherein the strip-position adjuster is between two heating subzones.

13. The method according to claim 10, wherein the strip-position adjuster or its strip-position detector is in an area of the heating zone where the temperature of the metal strip is more than 300° C.

14. The method according to claim 11, wherein the actual position is measured upstream of the linear actuators or downstream of the linear actuators or at the linear actuators.

15. The method according to claim 10, wherein the force exerted on the strip by the linear actuators is controlled across the strip-travel direction in proportion to the measured deviation of the strip from an ideal centered position.

16. The method according to claim 10, wherein a correction using the linear actuators is not performed when there is a deviation in the actual position from an ideal position within a tolerance range.

* * * * *